US006032580A

United States Patent [19]

Lee

[11] Patent Number: 6,032,580

[45] Date of Patent: Mar. 7, 2000

[54] STAMPING TOY WITH SOUND AND LIGHTING EFFECT

[76] Inventor: Tsu-Lin Lee, P.O. Box 82-144, Taipei, Taiwan

[21] Appl. No.: 09/288,954

[22] Filed: Apr. 9, 1999

[51] Int. Cl.[7] ..... B41L 47/02

[52] U.S. Cl. ..... 101/368; 101/372

[58] Field of Search ..... 101/368, 372, 101/379, 405, 406

[56] References Cited

U.S. PATENT DOCUMENTS

| | | | |
|---|---|---|---|
| 5,178,067 | 1/1993 | Collier | 101/405 |
| 5,579,692 | 12/1996 | Collier | 101/368 |
| 5,738,011 | 4/1998 | Tay | 101/368 |

*Primary Examiner*—John S. Hilten
*Assistant Examiner*—Anthony H. Nguyen
*Attorney, Agent, or Firm*—A & J

[57] ABSTRACT

A stamping toy with sound and lighting effect which comprises an ornamental seat, a main body mounted at the bottom of the ornamental seat, a bottom cap mounted at the bottom of the main body, a spring within the ornamental seat, a circuit board mounted at the bottom of the spring, a light emitting body, a plurality of batteries and a conductive spring being provided on the top of the circuit board, an isolation annular rim mounted at the bottom of the circuit board, a voice emitter (buzzer) mounted at the bottom of the isolation annular rim, a stamping seat mounted at he bottom of the voice emitter, and a rubber stamping design provided at the bottom of the stamping seat.

5 Claims, 9 Drawing Sheets

STAMPING TOY WITH SOUND AND LIGHTING EFFECT

BACKGROUND OF THE INVENTION

1. Field of the Invention

This present invention relates to a stamping toy, and in particular, to a stamping toy which can produce sound and lighting effect to attract the attention of children.

2. Description of the Prior Art

The construction of conventional stamping toy available in the market is of two types, which are shown in FIG. 7 and FIG. 11 of the drawings. As shown in FIG. 7, there is shown a first type of the conventional stamping toy having a light transmitting ornamental design 91, an ornamental seat 92, a spring 93, a moveable seat 94 having a stamping design 97, a main body 95 and a bottom cap 96 which is used to cover the main body 95. These parts are combined together to form the stamping toy 9 which is shown in FIG. 8. As shown in FIG. 9, a light emitting body 922 is provided on the ornamental seat 92 containing two batteries 925. One contacting leg 924 of the light emitting body 922 is kept in contact with the negative terminal of the batteries 925. A small hole 921 is provided at one lateral side of the ornamental seat 92. A round head push button 923 is contained within the small hole 921 and the top portion of the push button 923 is in contact with the top edge of the moveable sat 94. The ornamental seat 92 is connected to the moveable seat 94 by a spring 93. Due to the extension force of the spring 93, the moveable seat 94 is urged downward. FIG. 10 shows the light emission of the stamping toy 9. The bottom cap 96 is removed and the stamping design 97 is placed one a sheet of paper. When the stamping design 97 is pressed, the moveable seat 94 moves upward and the top edge urges the round head push button 923 to retract into the small hole 921. At the same time, the push button 923 urges the contacting leg 924 of the light emitting body 922 to contact with the positive terminal of the batteries 925 and the stamping toy 9 is thus lighted.

The second type of conventional stamping toy is shown in FIG. 11. The stamping toy comprises a light transmitting ornamental design 30, an ornamental seat 31, a buzzer 32, a circuit board 33, a stopping plate 34, a pressing spring 35, a conductive press key 36, a shafted disc 37, a stamping design 38, a main body 39, an outer cap 301, and a light emitting body 302 having two batteries 303. These parts are mounted together to form a stamping toy 300 which is shown in FIG. 12.

FIG. 13 illustrates the procedures of sound and lighting production. The outer cap 301 is removed and the stamping design 38 is placed on a sheet of paper. When the stamping toy 300 is pressed, the shafted disc 37 moves upward and the press key 36 at the top triggers the conductive end of the circuit board 33, such that the light emitting body 302 and the buzzer 303 produce a sound and a lighting effect.

Other than the above methods of providing a sound and a lighting effect, there are simpler methods with convenient control for a stamping toy to produce sound and lighting effect in accordance with the present invention.

SUMMARY OF THE INVENTION

The present invention comprises an ornamental seat, a main body mounted a the bottom of the ornamental seat, a bottom cap mounted at the bottom of the main body, a spring within the ornamental seat, a circuit board mounted at the bottom of the spring, a light emitting body, a plurality of batteries and a conductive spring being provided on the top of the circuit board, an isolation annular rim mounted at the bottom of the circuit board, a voice emitter (buzzer) mounted at the bottom of the isolation annular rim, a stamping seat mounted at the bottom of the voice emitter, and a rubber stamping design provided a the bottom of the stamping seat.

In accordance with one aspect of the present invention, the ornamental seat is fixed to the main body and the stamping seat, a voice emitter, an isolation annular rim and he circuit board are mounted within the main body. When the ornamental seat is pressed, the ornamental seat and the body are lowered, and the stamping seat and the voice emitter, the isolation annular rim and the circuit board move upward at the same time such that one end of the conductive spring on the circuit board is biased and lowered to touch the terminal of the batteries as a result of the protruded rim on the ornamental seat. Thus, the voice emitter and the light emitting body produce a sound and lighting effect.

When the pressure of the stamping toy is released, the restoration force of the spring causes the ornamental seat and the main body to rise upward and the stamping seat, voice emitter, an isolation annular rim and the circuit board move downward to their respective position. In addition, the conductive spring restores to its original position without touching the batteries. Thus, neither sound nor lighting effect is produced.

DETAILED DESCRIPTION OF THE PREFERRED EMBODIMENT

Figure 1:
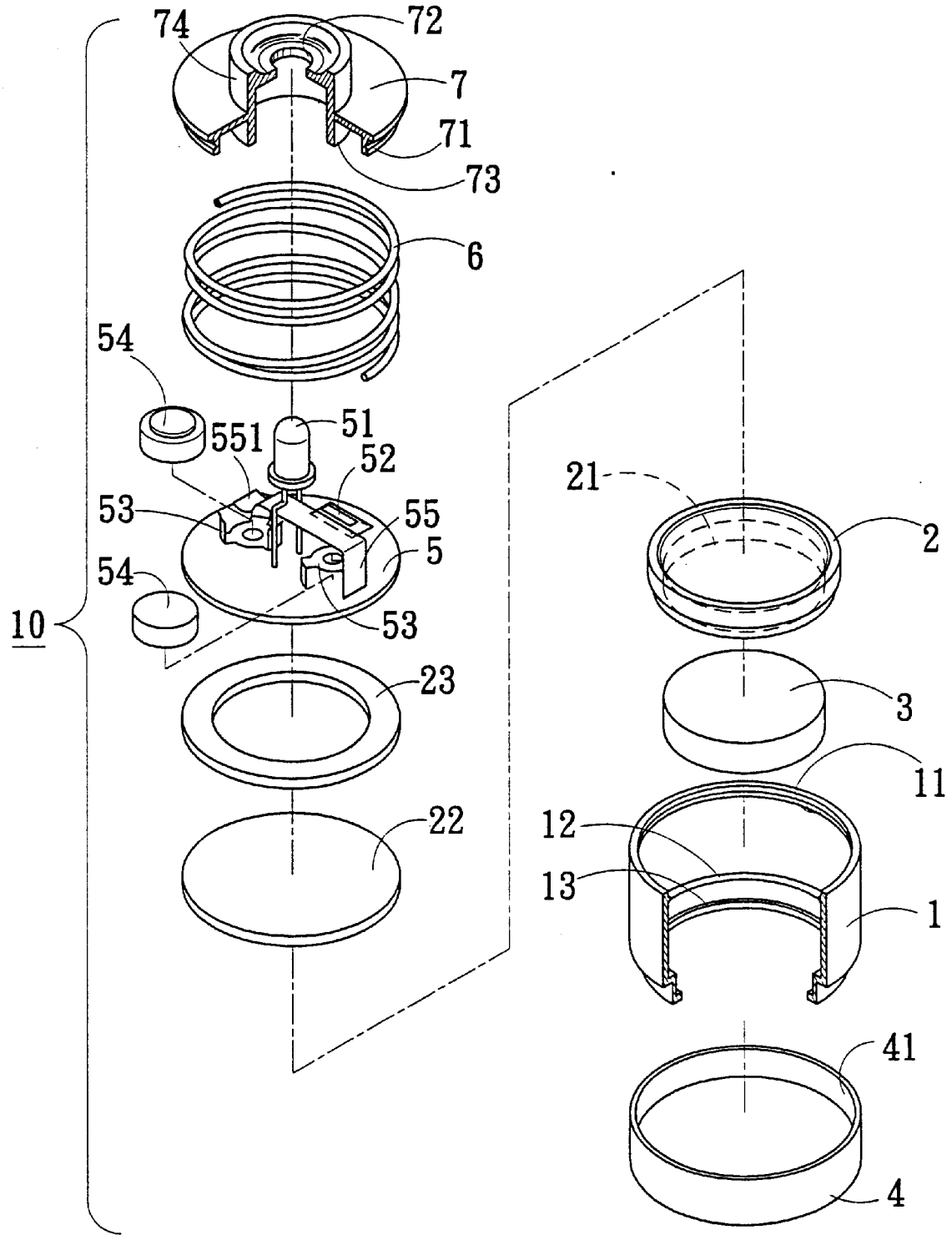
FIG. 1 is an exploded perspective view of the stamping toy of the present invention.
Figure 2:
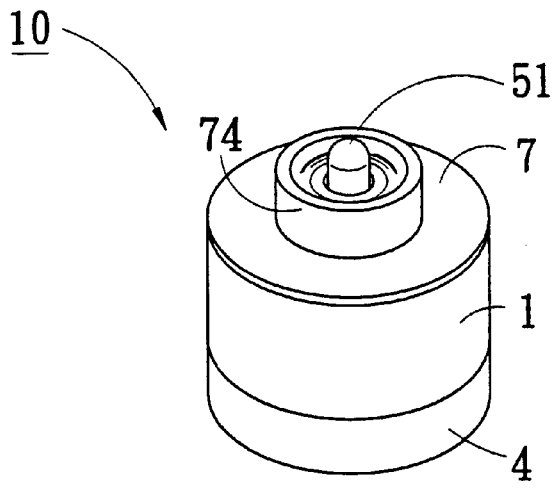
FIG. 2 is a perspective view of the stamping toy of the present invention.

Referring to FIG. 1, this figure shows an exploded view of the stamping toy 10, comprising an ornamental seat 7, a main body 1 mounted at the bottom of the ornamental seat 7, a bottom cap 4 mounted at the bottom of the main body 1, a spring 6 within the ornamental seat 7, a circuit board 5 mounted at the bottom of the spring 6, a light emitting body 51 mounted on the circuit board 5, an IC member 52, two battery slot 53 mounted on the circuit board 5, two batteries 54 mounted within the battery slot 53, a conductive spring 55 being provided on the top of the circuit board 5, an isolation annular rim 23 mounted at the bottom of the circuit board 5, a voice emitter 22 (a buzzer) mounted at the bottom of the isolation annular rim 23, a stamping seat 2 mounted at the bottom of the main body 1, and a rubber stamping design 3 provided at the bottom of the stamping seat 2. The combination of these parts to form a stamping toy 10 is shown in FIG. 2 of the present invention.

Figure 3:
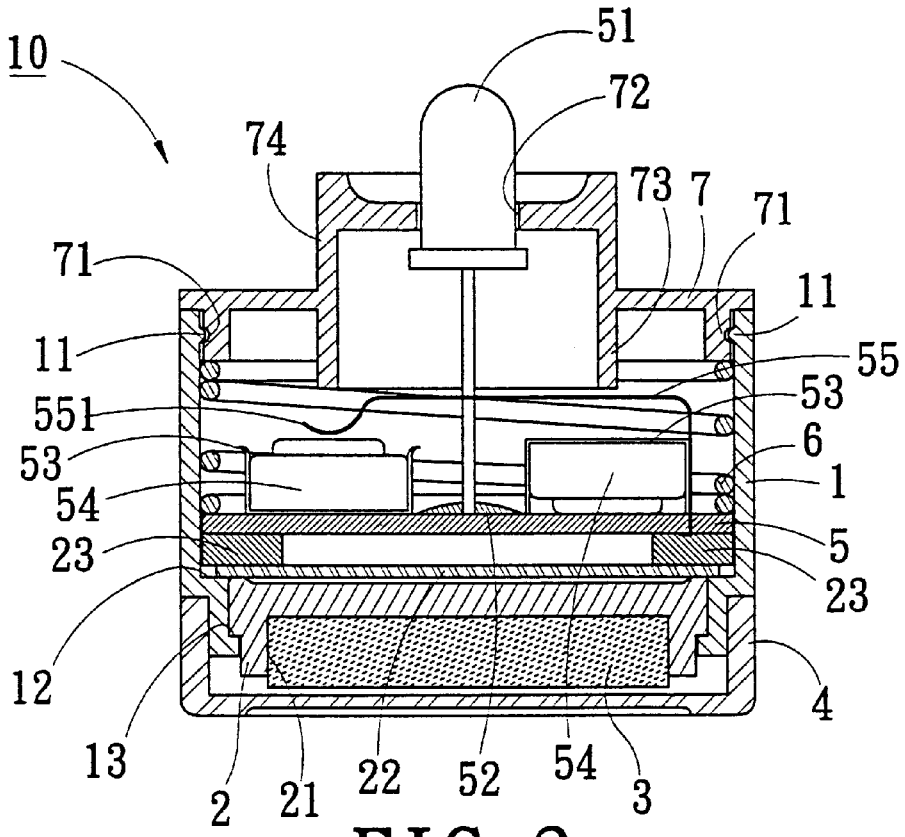
FIG. 3 is a sectional view illustrating various parts of the stamping toy of the present invention.

Referring to FIG. 3 of the present invention, there is shown a sectional view of the stamping toy 10. The lower section of the inner wall of the main body 1 is provided with a stepped, protruded top stopping rim 12 and a bottom stopping rim 13, wherein the bottom stopping rim 13 is functioned to block the stamping seat 12 so as to prevent its dislocation from the main body 1. The stamping seat 2 has a recess 21 having downward facing opening for the adaptation of a rubber stamping design 3. Further, the top stopping rim 12 is functioned to block the dislocation of the voice emitter 22, and the voice emitter 22 is located at the top of the stamping seat 2 and in contact with the stamping seat 2. On the top of the voice emitter 22, the isolation annular rim 23, the circuit board 5 are mounted. The isolation annular rim 23 is functioned to prevent short circuit of the circuit board 5.

In accordance with the present invention, the main body 1 and the bottom cap 4 are mounted together tightly. When the stamping design 3 is not in use, the bottom cap 4 covers the stamping design 3 to avoid contamination and to prevent ink evaporation from the stamping design 3.

The top end of the inner wall of the main body 1 is provided with a circular rib 11 engageable with the circular groove 71 at the bottom edge of the external wall of the ornamental seat 7 to form a unit. A cylindrical body 74 is protruded out from the top end of the ornamental seat 7, wherein a small hole 72 is provided at the center thereof for the mounting of a light emitting body 51 (for instance, Light Emitting Diode). A protruded rim 73 is extended out from the center bottom face of the ornamental seat 7, and it is used to urge the conductive spring 55. In accordance with the present invention, the conductive spring 55 is a L-shaped spring having one end being mounted onto the circuit board 5 and the other free end being a downward bent contacting disc 551. The contacting disc 551 is located at the top end of the battery 54 but does not contact with the battery 54.

Two battery slots 53 are provided on the circuit board 5 and contain two batteries 54. An IC member 52 is provided on the circuit board 5, which is used to control the duration time for the light emitting body 51 and the voice emitter 22 to provide a lighting a sound effect.

Figure 4:
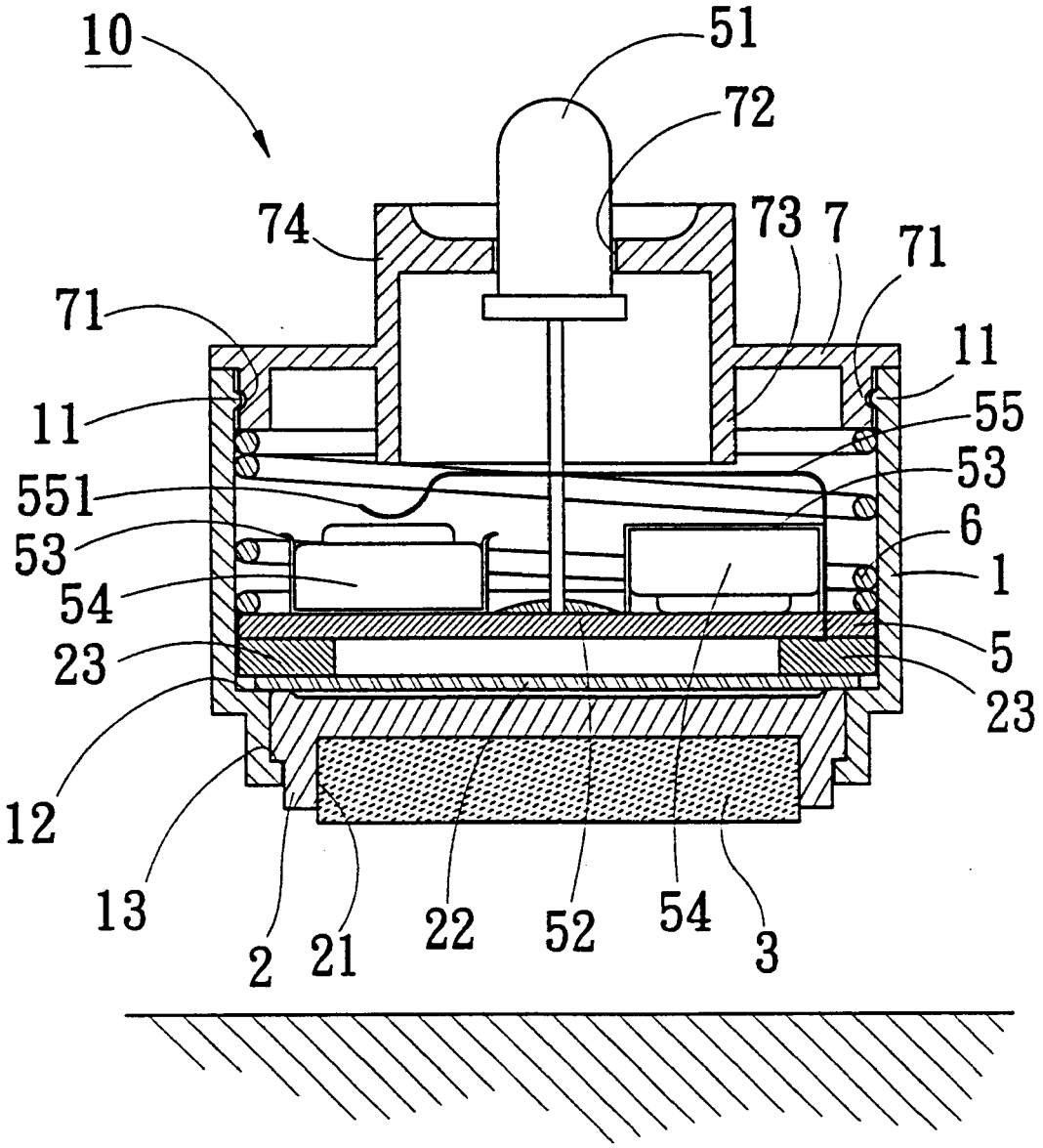
FIG. 4 is a schematic view illustrating the stamping toy before the toy is pressed downward, of the present invention.

Referring to FIG. 4, when the stamping toy 10 is used. The bottom cap 1 is removed. At this instant, the contacting disc 551 of the conductive spring 55 has not in contact wit the terminal of the battery. Thus, the IC member 52 does not function, and neither the light emitting body 51 nor the voice emitter 22 is functioned.

Figure 5:
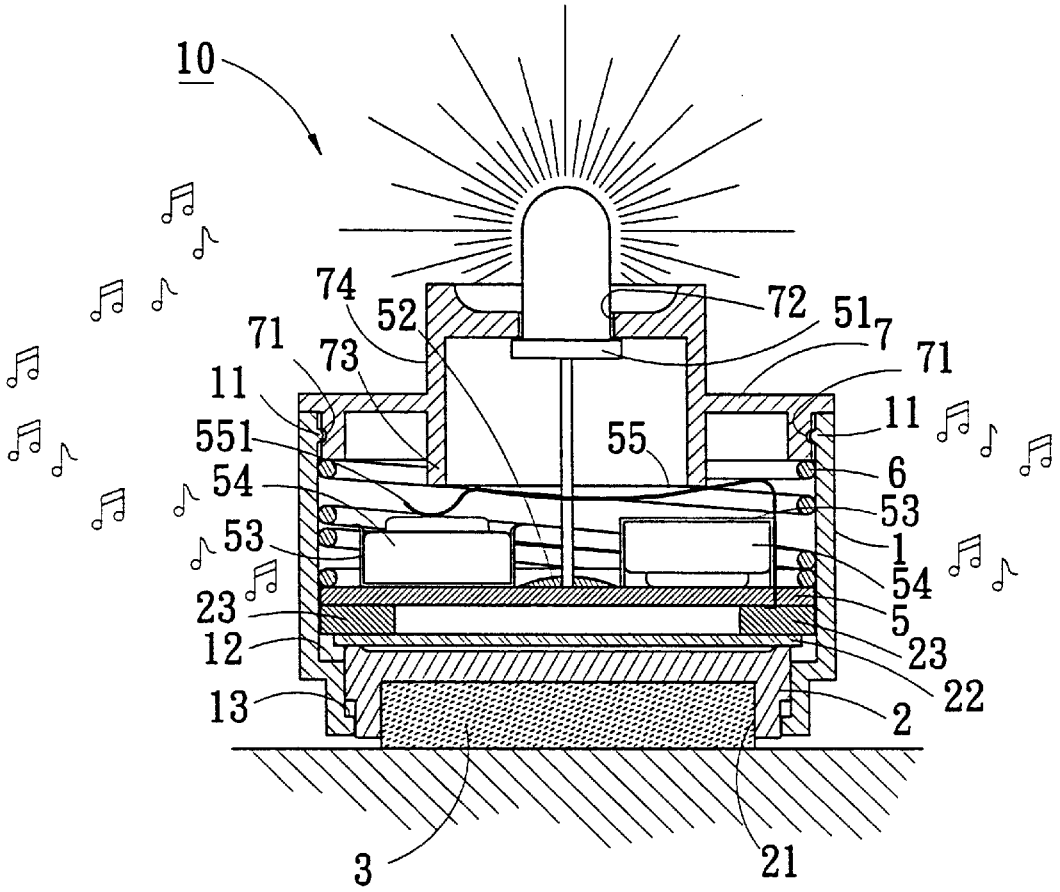
FIG. 5 is a sectional view illustrating the stamping toy after the toy is pressed downward.

Referring to FIG. 5, when the stamping toy 10 is pressed downward. The ornamental seat 7 and the main body 1 move downward altogether, and the stamping seat 2, the voice emitter 22, the isolation annular rim 23, the circuit board 5 rise upward at the same time such that the spring 6 is at a state of compression. At this moment, the protruded rim 73 of the ornamental seat 7 urges the conductive spring 55 and causes the contacting disc 551 to contact with the terminal of the batteries 54. In addition, the IC member 52 is thus activated. This will cause the light emitting body 51 to flash and the voice emitter 22 to produce a sound (music) until a controlled time has attained.

In accordance with the present invention, when the pressure is released. The spring 6 causes the ornamental seat 7 and the main body to rise upward, and the stamping seat 2, the voice emiteer 22, the isolation annular rim 23 and the circuit board 5 move downward so as to urge the ornamental seat 7 and the main body 1 to move upward at the same time and return to their original positions. At this moment, the conductive spring 55 restores to its original shape and does not contact with the terminal of the batteries 54. At this point, the current to the IC member 52 is terminated and the sound and lighting effect is thus stopped.

Figure 6:
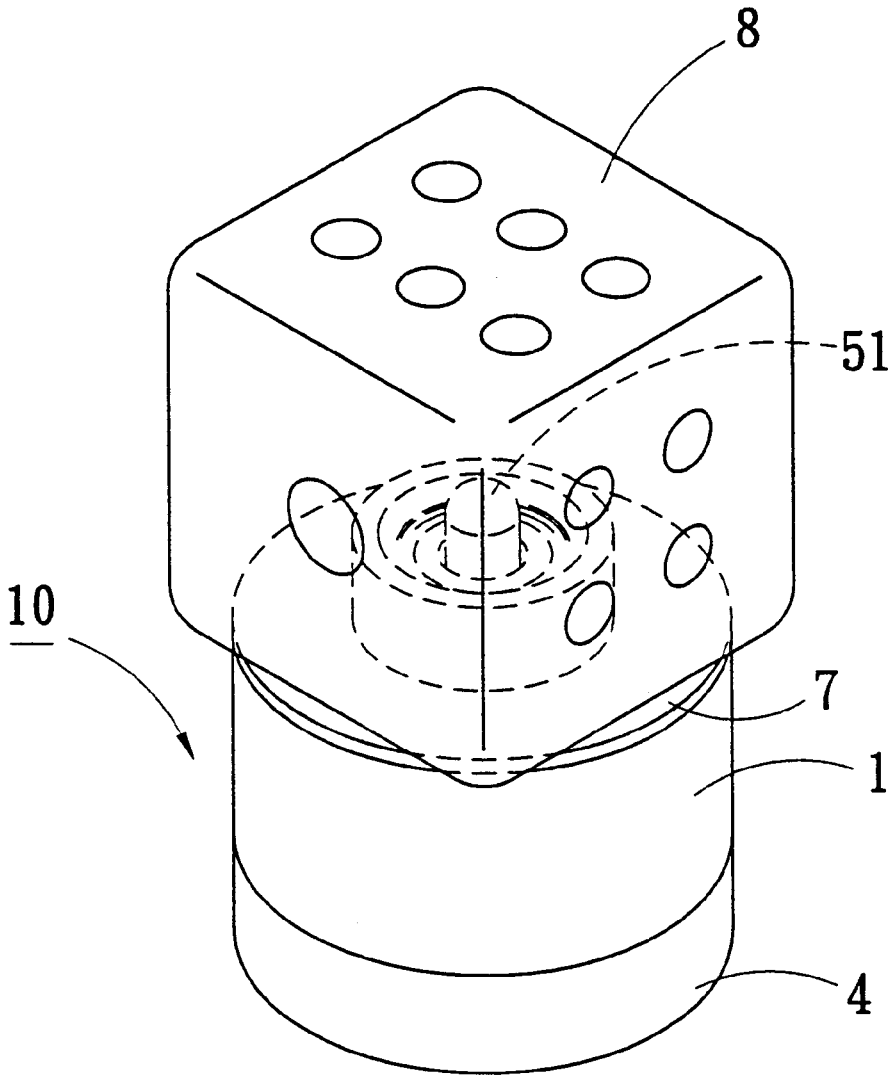
FIG. 6 is a perspective view of the stamping toy in accordance with the present invention.
Figure 7:
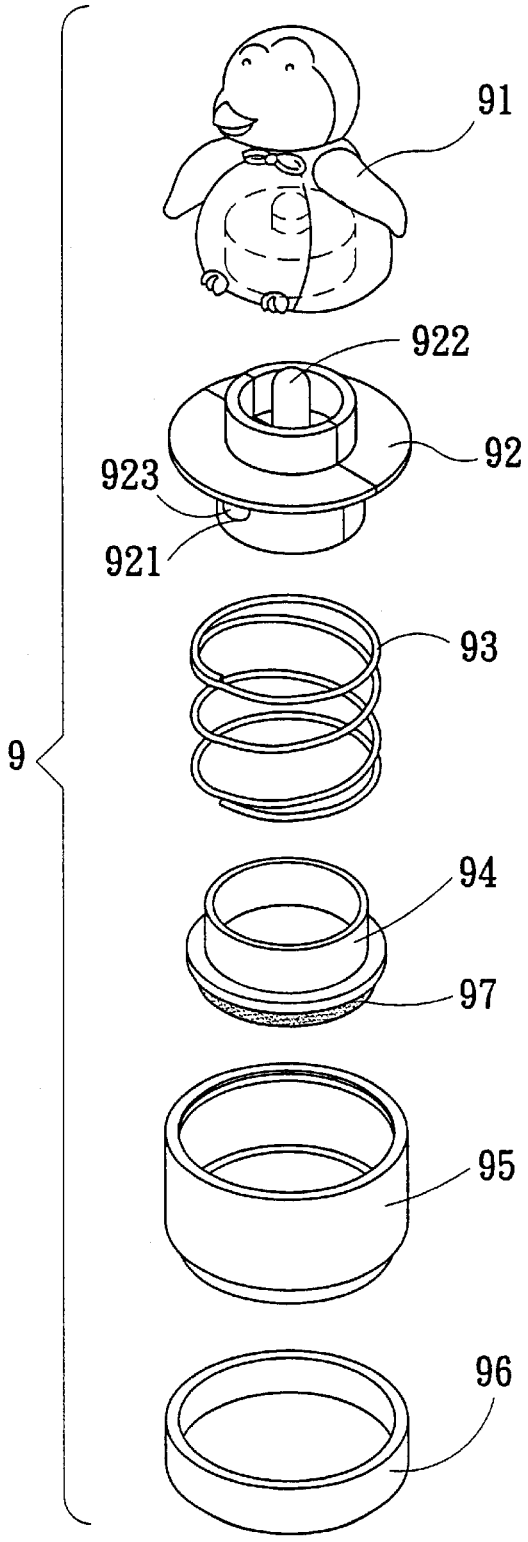
FIG. 7 (PRIOR ART)
FIG. 7 is an exploded perspective view of a conventional stamping toy.
Figure 8:
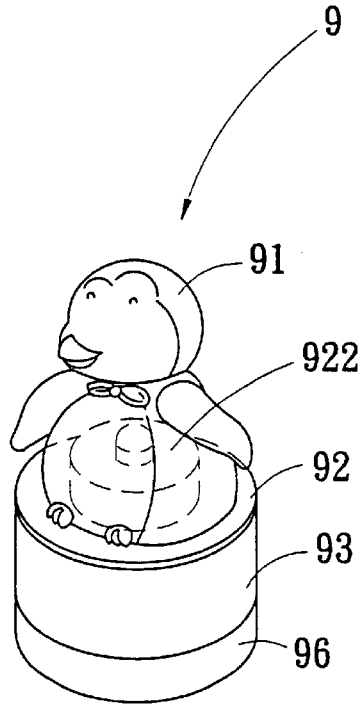
FIG. 8 (PRIOR ART)
FIG. 8 is a perspective view of a conventional stamping toy.
Figure 9:
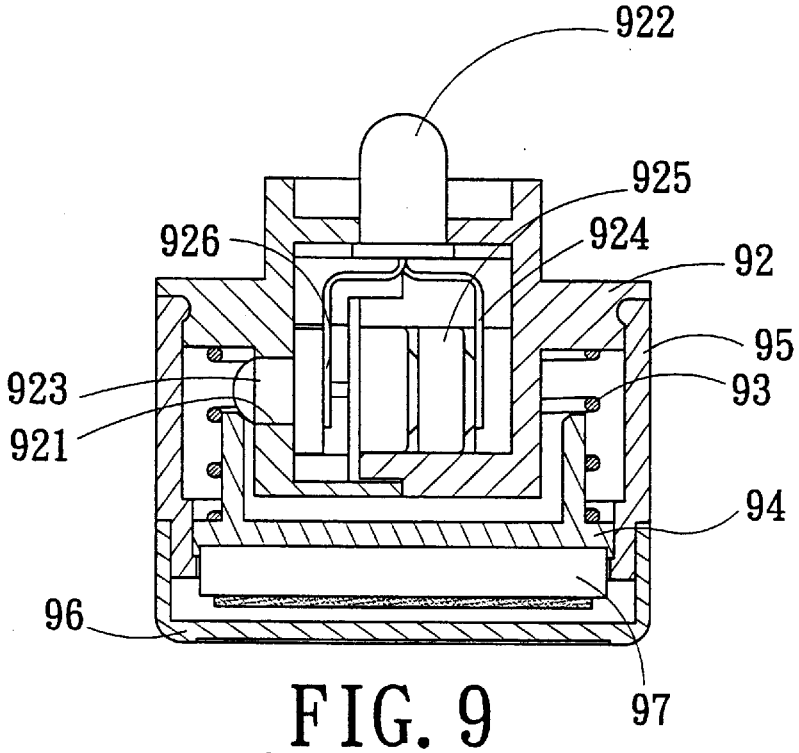
FIG. 9 (PRIOR ART)
FIG. 9 is a sectional view of a conventional stamping toy.
Figure 10:
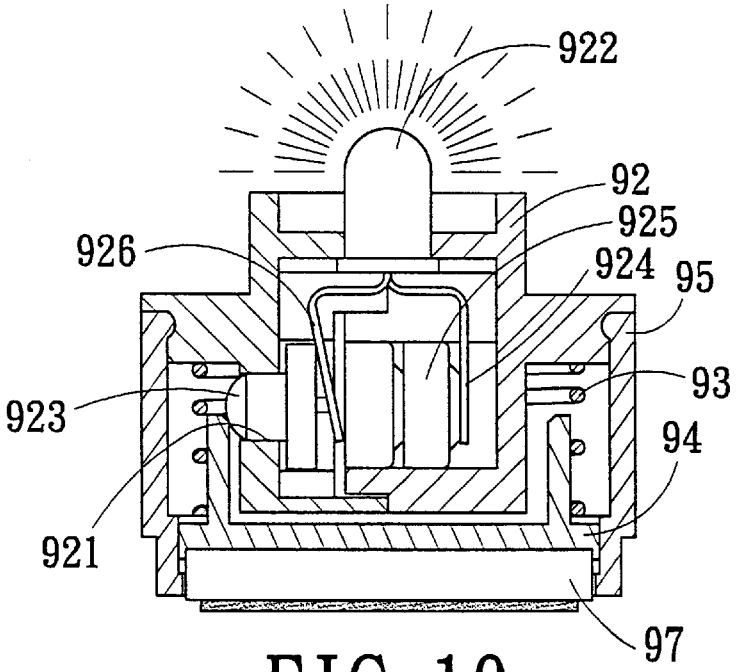
FIG. 10 (PRIOR ART)
FIG. 10 is a sectional view illustrating the conventional stamping toy being pressed.
Figure 11:
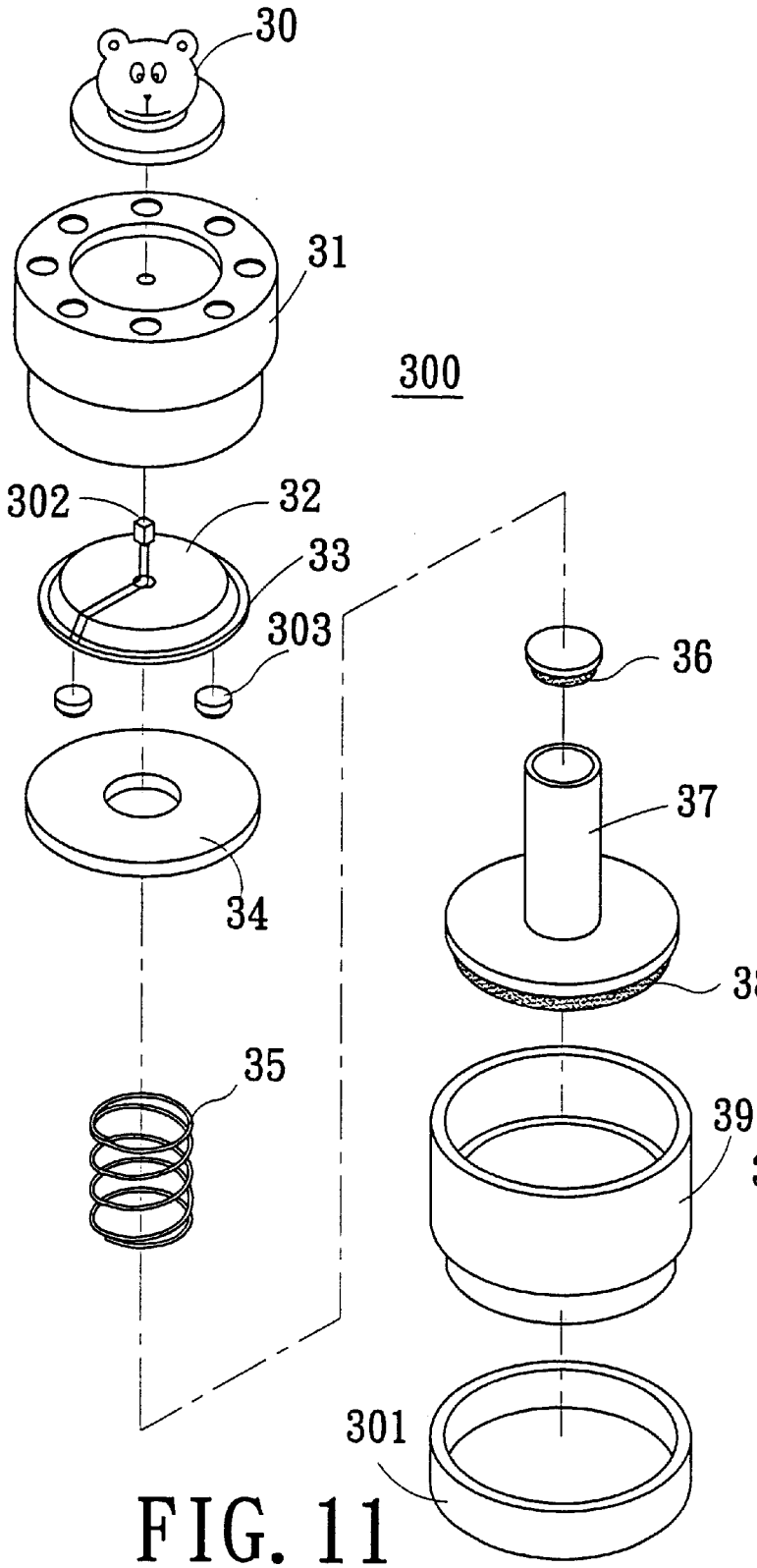
FIG. 11 (PRIOR ART)
FIG. 11 is a perspective exploded view of another conventional stamping toy.
Figure 12:
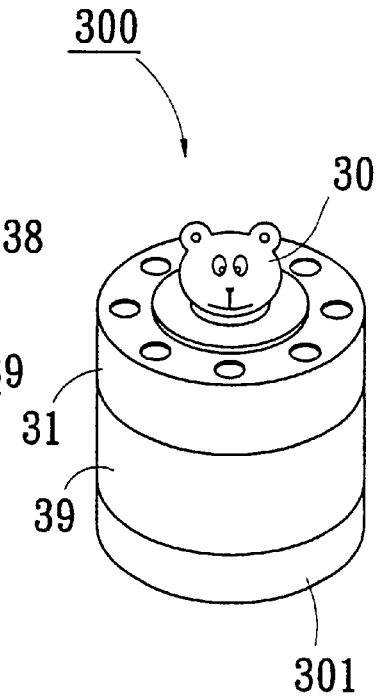
FIG. 12 (PRIOR ART)
FIG. 12 is a perspective view of another conventional stamping toy.
Figure 13:
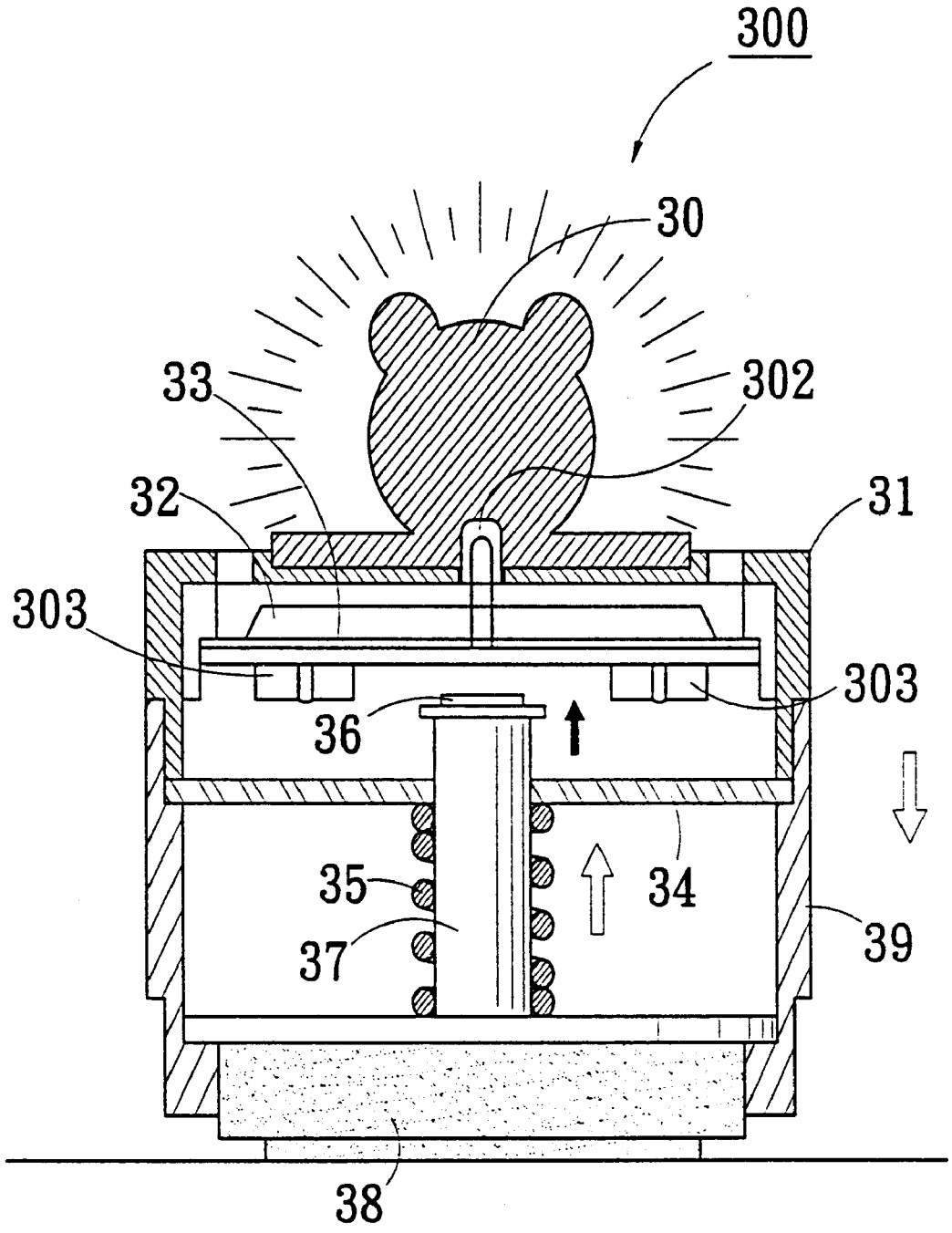
FIG. 13 (PRIOR ART)
FIG. 13 is a sectional view of another conventional stamping toy illustrating the stamping toy being pressed.

Referring to FIG. 6 of the present invention, the stamping toy 10 can be provided with ornamental designs such as transparent or translucent animation figures or cartoon figures. In accordance wit the present invention, the stamping toy 10 can provide either with a voice emitter 22 or a light emitting body 51.

While the invention has been described with respect to a preferred embodiment thereof, it will be understood by those skilled in the art that various changes in detail may be made therein without departing from the spirit, scope, and teaching of the invention. Accordingly, the invention herein disclosed is to be limited only as specified in the following claims.

I claim:

1. A stamping toy with sound and lighting effects comprising an ornamental seat having a protruded rim on the bottom thereof, a spring, a circuit board, a light-emitting body, two batteries, a conductive spring, an isolation annular rim, a voice emitter, a stamping seat, a rubber stamp design, an annular body, a bottom cap, characterized in that the stamping seat has a rubber stamping design provided at the bottom end of the inner section of the annular body, the voice emitter being mounted with the isolation annular rim and the circuit board is disposed onto the top of the stamping seat, the light-emitting body mounted on the circuit board which is mounted onto the ornamental seat, the conductive spring being mounted onto the circuit board and having one free end which is adjacent to the tope of the batteries without touching the batteries, a spring is mounted in between the annular body and the ornamental seat such that when the stamping toy is pressed from the top thereof, the ornamental seat and the main body are lowered, and a protruded rim at the bottom of the ornamental seat presses the conductive spring and moves the free end of the conductive spring into contact with the terminal of the batteries to activate the light emitting body and the voice emitter to produce flashes of light and music when the stamping toy is pressed.

2. The stamping toy as set for the in claim 1, wherein a top stopping rim and a bottom rim are mounted at the bottom end of the inner wall of the main body, the bottom stopping rim serving to block the stamping seat so as to prevent dislocation from the main body, the top stopping rim serving to block the dislocation of the voice emitter.

3. The stamping toy as set forth in claim 1, wherein the voice emitter is located at the top and in contact with the stamping seat.

4. The stamping toy as set forth in claim 1, wherein the ornamental seat including a circular groove at the lower edge of the external wall of the ornamental seat and a circular rib is provided at the tope end of the circular groove as one unit.

5. The stamping toy as set forth in claim 1, wherein the conductive spring is a L-shaped spring, having one free end facing downward as a contacting disc, the contacting disc being located at the top end of the battery but not in contact with the battery.

* * * * *